US007671708B2

(12) United States Patent
Lagorsse et al.

(10) Patent No.: US 7,671,708 B2
(45) Date of Patent: Mar. 2, 2010

(54) MECHANICAL TEMPERATURE-COMPENSATING DEVICE FOR A PHASE-STABLE WAVEGUIDE

(75) Inventors: Joel Lagorsse, Castanet Tolosan (FR); Dominique Bugada, Labruyere Dorsa (FR)

(73) Assignee: Thales (FR)

( * ) Notice: Subject to any disclaimer, the term of this patent is extended or adjusted under 35 U.S.C. 154(b) by 144 days.

(21) Appl. No.: 12/143,723

(22) Filed: Jun. 20, 2008

(65) Prior Publication Data

US 2008/0315974 A1 Dec. 25, 2008

(30) Foreign Application Priority Data

Jun. 22, 2007 (FR) ..... 07 04504

(51) Int. Cl.
*H01P 1/207* (2006.01)
*H01P 1/30* (2006.01)

(52) U.S. Cl. ..... 333/234; 333/208

(58) Field of Classification Search ..... 333/202, 333/208, 209, 219, 227, 229, 234, 248
See application file for complete search history.

(56) References Cited

U.S. PATENT DOCUMENTS 4,057,772 A 11/1977 Basil et al.
5,428,323 A 6/1995 Geissler et al.
5,610,562 A 3/1997 Geissler et al.
6,535,087 B1 * 3/2003 Fitzpatrick et al. ..... 333/229
7,453,337 B2 * 11/2008 Lagorsse et al. ..... 333/229
7,564,327 B2 * 7/2009 Engel et al. ..... 333/229
7,564,328 B2 * 7/2009 Engel et al. ..... 333/239

FOREIGN PATENT DOCUMENTS

EP 1187247 3/2002

* cited by examiner

*Primary Examiner*—Dean O Takaoka
(74) *Attorney, Agent, or Firm*—Lowe Hauptman Ham & Berner, LLP

(57) ABSTRACT

The present invention relates to a mechanical compensating device for a waveguide (1). More precisely, the present invention provides a technology for ensuring phase stability in a waveguide (1) subject to expansions and contractions owing to temperature changes. To do this, actuators, which may consist of pairs of prongs (8-9, 10-11), connected to longitudinal ribs (2, 3) cut in the body of the waveguide (1) and integral therewith, cause, because of a large difference between the respective coefficients of thermal expansion of the waveguide (1) and of the actuators, a rotation of the longitudinal ribs (2, 3) about themselves, deforming the short sides (4, 5) of the waveguide (1) when said waveguide (1) expands or contracts according to the changes in temperature.

12 Claims, 4 Drawing Sheets

MECHANICAL TEMPERATURE-COMPENSATING DEVICE FOR A PHASE-STABLE WAVEGUIDE

RELATED APPLICATIONS

The present application is based on, and claims priority from, French Application Number 07 04504, filed Jun. 22, 2007, the disclosure of which is hereby incorporated by reference herein in its entirety.

FIELD OF THE INVENTION

The present invention relates to a mechanical compensating device for a waveguide. More precisely, the present invention provides a solution using a technology for ensuring phase stability in a waveguide subject to expansions and contractions owing to temperature changes.

DISCUSSION OF THE BACKGROUND

In particular, in the case of multiplexers-demultiplexers (or Omux) integrated for example into space instruments, and comprising specific waveguides commonly called manifolds, the temperature changes may be large. These manifolds, which typically are made of aluminium, the coefficient of thermal expansion (CTE) of which is equal to 23 ppm, the deformations induced by these temperature changes are such that phase shifts are introduced into the guided waves. These phase shifts result in malfunction of the equipment. For example, Omux channel mismatches may occur.

To correct this problem, several technologies have been developed. The first method consists in producing the waveguide and the manifold in a material having a coefficient of thermal expansion as low as possible. Materials such as Invar™ have a coefficient of thermal expansion that may be down to 0.5 ppm, giving them a very low deformability with respect to temperature changes. However, for practical reasons, notably because the waveguides are mounted in space equipment generally produced in lightweight materials, the coefficients of thermal expansion of which are high, such as aluminium for example, mechanical compensation solutions are sought, notably for operating with aluminium waveguides. This is because too large a difference between the coefficient of thermal expansion of the manifold and that of the complete equipment on which it is mounted induces large mechanical stresses. To reduce these stresses, it is necessary to even out the coefficients of thermal expansion.

Nowadays, it is known that the thermal expansion of a waveguide of rectangular cross section can be compensated for by applying a deformation on its short sides so as to ensure phase stability. One existing technology consists in deforming the waveguide by pressing or pulling on its short sides by means of spacer components that move along an axis orthogonal to the short sides of the waveguide.

However, these technologies generally require the use of very large plates made of Invar™ (or another material having a similar coefficient of thermal expansion) that are parallel to the long sides of the waveguide and keep them spaced apart. The presence of these plates increases the space taken up by the waveguide.

To alleviate this drawback, the invention proposes the use of actuators made of Invar™ or another material of low coefficient of thermal expansion which, under the effect of a temperature change, cause longitudinal off-axis ribs, cut from the body of the waveguide and integral therewith, to rotate, deforming the short sides of the waveguide.

SUMMARY OF THE INVENTION

For this purpose, the subject of the invention is a compensated waveguide device comprising a waveguide having:

a first coefficient of thermal expansion; and at least one long side and at least one short side, the short side having a median axis and the waveguide further including at least one longitudinal rib having a surface at least partly common with the short side of the waveguide over approximately one half of the width of the short side, the longitudinal rib being off-axis relative to the median axis of the short side of the waveguide and cut in the body of the waveguide, the compensated waveguide device comprising, in contact with the longitudinal rib, means for rotating the longitudinal rib about itself, causing a deformation of the short side of the waveguide.

Advantageously, the waveguide has a rectangular cross section and therefore comprises two short sides and two long sides.

Advantageously, the means for rotating the longitudinal rib comprise at least one element of low thermal deformability, having a second coefficient of thermal expansion smaller than the first coefficient of thermal expansion.

Advantageously, the second coefficient of thermal expansion is smaller than the first coefficient of thermal expansion by a factor of at least 5.

Advantageously, the means for rotating the longitudinal rib consist of a bimetallic strip comprising at least the element of low thermal deformability, having the second coefficient of thermal expansion, and a complementary element having a third coefficient of thermal expansion larger than the second coefficient of thermal expansion.

Advantageously, the element of low thermal deformability of the bimetallic strip is made of Invar™ and the complementary element of the bimetallic strip is made of aluminium.

Advantageously, the means for rotating the longitudinal rib comprise a first type of pair of prongs corresponding to the element of low thermal deformability, and a brace having the first coefficient of thermal expansion, fastened to the waveguide and being interposed between the prongs.

Advantageously, the prongs are made of Invar™ and the waveguide and the brace are made of aluminium.

Advantageously, the means for rotating the longitudinal rib comprise a frame having a fourth coefficient of thermal expansion larger than the second coefficient of thermal expansion and a second type of pair of prongs corresponding to the element of low thermal deformability and furthermore providing the linkage between the longitudinal rib and the frame.

Advantageously, the device comprises two opposed longitudinal ribs separated by a long side of the waveguide, and two pairs of prongs of the second type of pair of prongs connected to the ends of the longitudinal ribs.

Advantageously, the pairs of prongs are made of Invar™, the frame is made of aluminium or titanium, and the waveguide is made of aluminium or titanium.

Advantageously, the pairs of prongs are made of titanium, and the frame and the waveguide are made of aluminium.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious aspects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

DETAILED DESCRIPTION OF THE INVENTION

Figure 1:
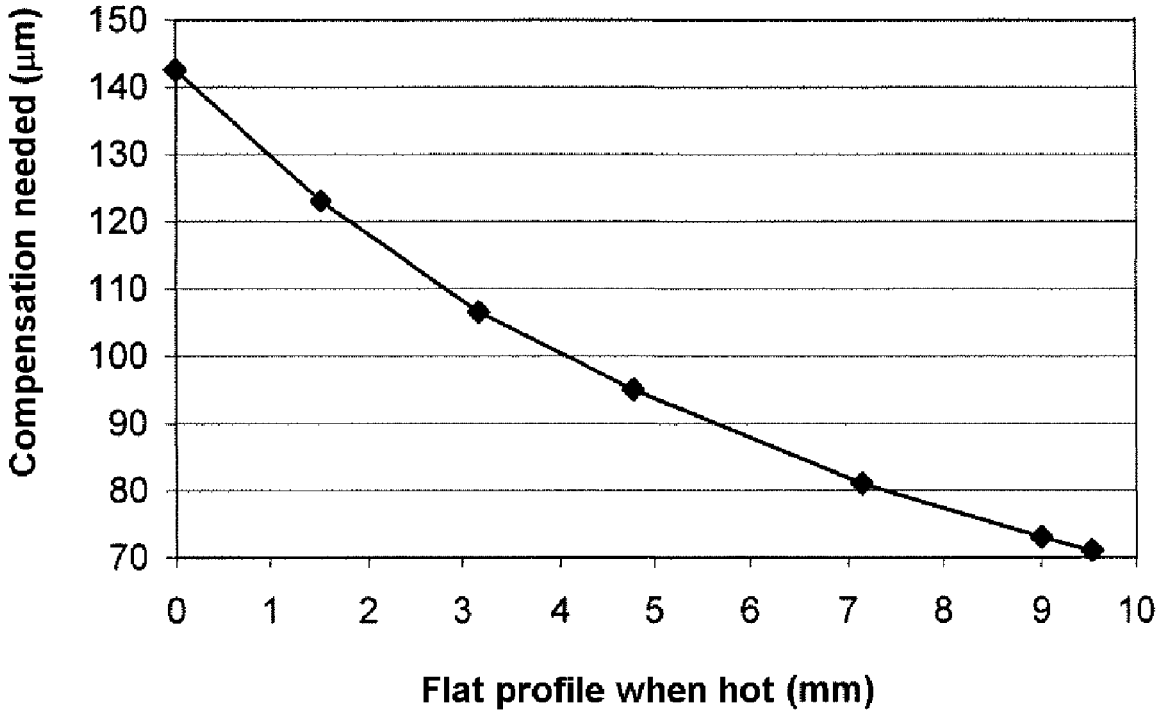
FIG. 1: a curve showing the deformations to be applied to an aluminium waveguide at 85° C. for the purpose of ensuring phase stability within the waveguide.

FIG. 1 shows a simulation of deformations to be applied to the short sides of an aluminium waveguide of rectangular cross section so as to ensure phase stability therein. To simplify matters, a deformation profile of isosceles trapezoidal shape, the short base of which is called the flat profile, is considered. Therefore, for theoretically perfect compensation, the curve shown in FIG. 1 indicates the sum of the deformations to be applied to the short sides according to the size of the flat profile, at 85° C., for a temperature between 20° C. and 85° C. The worst case, corresponding to a zero flat profile, i.e. a triangular deformation, would impose a total compensation of 142 μm, i.e. 71 μm on each of the short sides. In practice, since the deformation is instead curved, the compensation requirement is typically around 50 μm on the two short sides. Such deformations are achieved thanks to the mechanical compensation device described below.

Figure 2A:
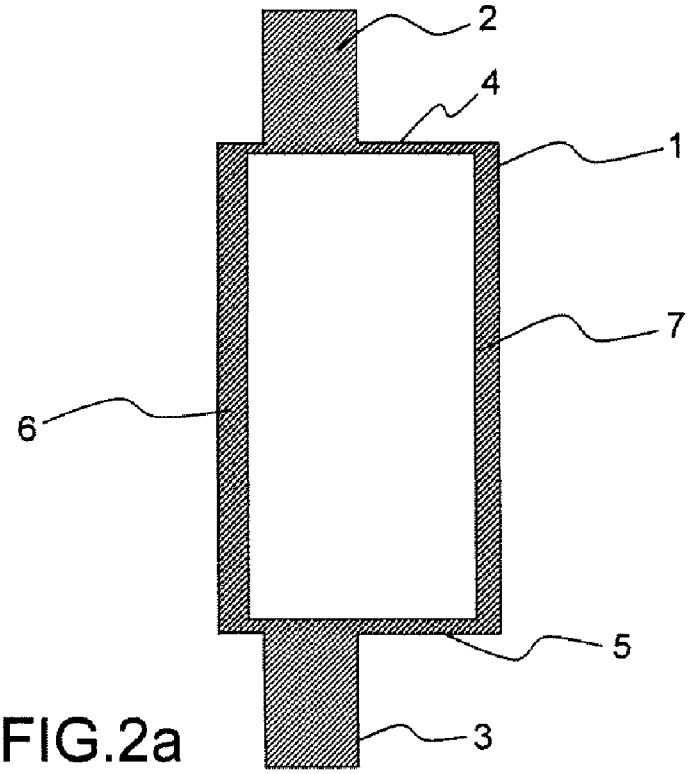
FIG. 2*a:* a diagram showing the principle of the invention with a nominal temperature (with no deformation)

FIG. 2*a* shows a diagram of the device according to the invention at a normal temperature, where there is no deformation. The waveguide 1 has a rectangular cross section, comprising two long sides 6 and 7 and two short sides 4 and 5. Two longitudinal ribs 2 and 3 are moreover cut in the body of the waveguide 1 and integral therewith. These longitudinal ribs 2 and 3 have a surface common with the respective short sides 4 and 5 of the waveguide 1 over approximately one half of the width of these short sides. They are also mutually parallel and off-axis relative to the median axis of the short sides 4 and 5.

Figure 2B:
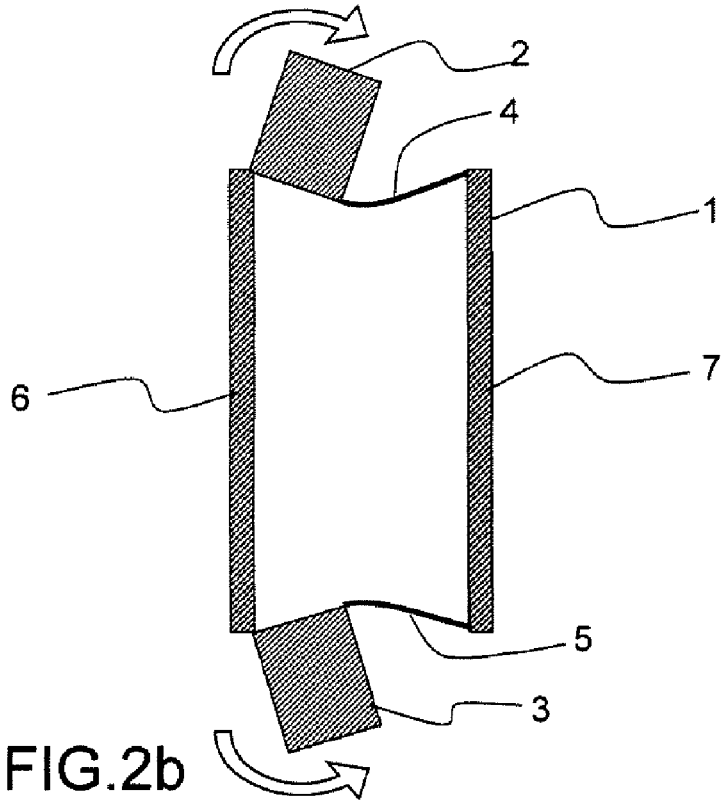
FIG. 2*b:* a diagram showing the principle of the invention at a high temperature (with deformation of the waveguide)

FIG. 2*b* shows the behavior of the device according to the invention upon being heated up. The principle consists in causing the short sides 4 and 5 of the waveguide to deform by rotation of the longitudinal ribs 2 and 3.

To rotate these longitudinal ribs 2 and 3, it is possible for example to use actuators such as bimetallic strips. These typically consist of two plates of materials having very different coefficients of thermal expansion, such as Invar™ and aluminium. Under the effect of a change in temperature, the bimetallic strip deforms and, if judiciously positioned in contact with a longitudinal rib, causes it to rotate. However, other preferred means may also be employed, such as those described below.

Figure 3A:
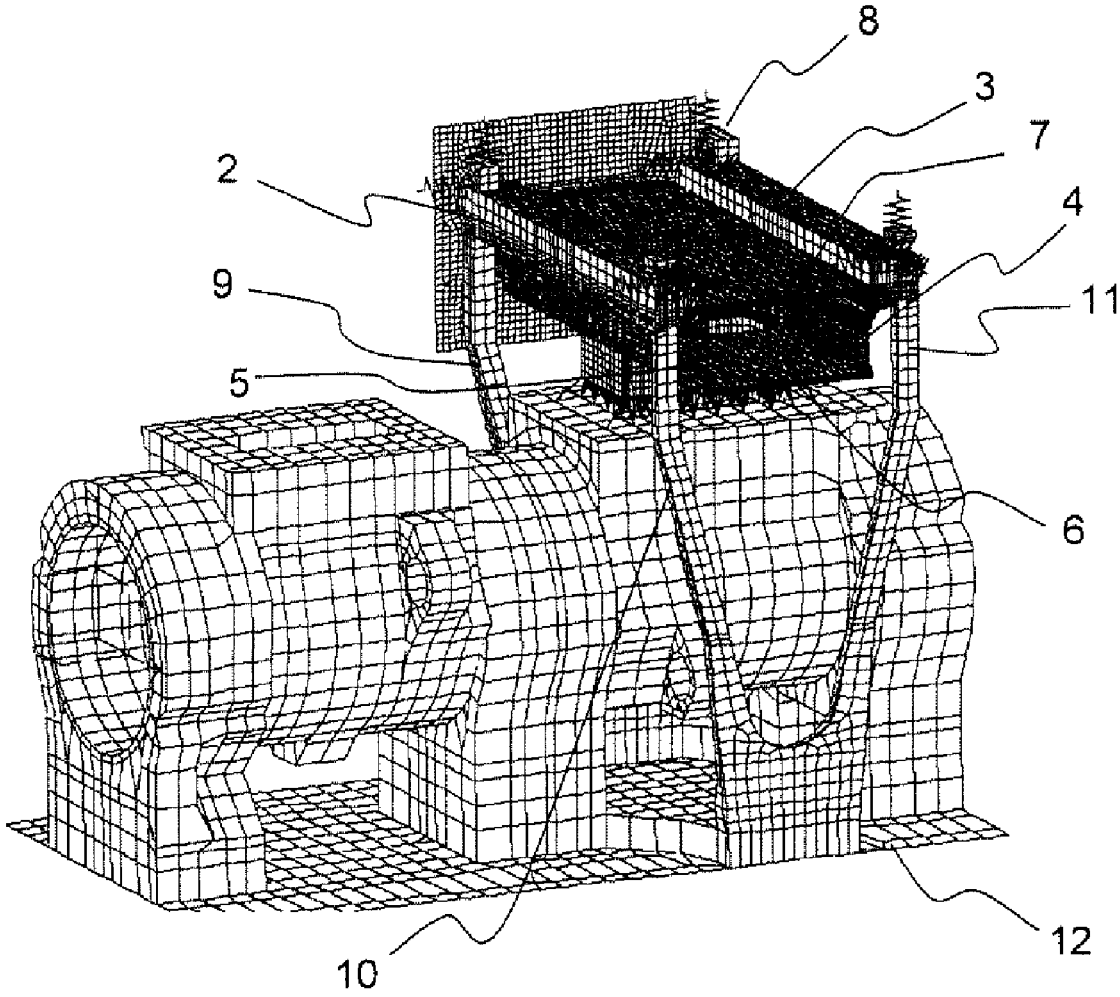
FIG. 3*a:* a diagrammatic illustration of one example of a device according to the invention at a nominal temperature (no deformation)
Figure 3B:
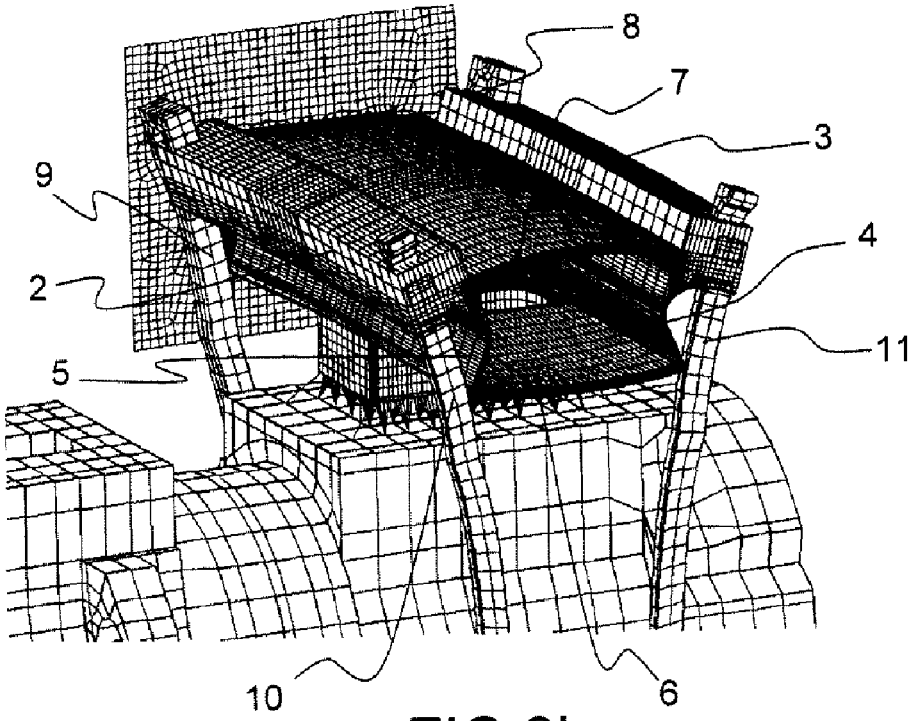
FIG. 3*b:* a schematic illustration of one example of a device according to the invention highlighting the deformation of the waveguide by rotation of the ribs about themselves.

FIGS. 3*a* and 3*b* explain how the longitudinal ribs can be rotated.

FIG. 3*a* illustrates the device mounted on any Omux (not shown fully), in which the frame 12 is typically made of aluminium. Each end of the two longitudinal ribs 2 and 3 is linked to the frame 12 of the Omux via prongs 8, 9, 10 and 11 made of a material having a low coefficient of thermal expansion, such as Invar™ for example. The prongs 8 and 9 on the one hand and 10 and 11 on the other join together at a common base on the frame, which is made of the same material as the prongs. Thus, the spacing within the prongs is virtually constant, whatever the temperature may be. In contrast, the waveguide 1 expands or contracts when the temperature increases or decreases, being made of a material having a high coefficient of thermal expansion, such as aluminium.

Consequently, as shown in FIG. 3*b,* which is an enlargement of one region of the waveguide 1 of FIG. 3*a,* when the waveguide 1 expands, since the spacing between the prongs 8 and 9 on the one hand and 10 and 11 on the other is constant, the tensile and compressive forces that are exerted on the prongs 8, 9, 10 and 11 are transmitted to the ribs 2 and 3, which undergo a rotation about themselves and deform the short sides 4 and 5 of the waveguide 1.

By deforming the short sides 4 and 5 of the waveguide 1, it is possible to compensate mechanically for the phase shift introduced by the expansion of the waveguide. The principle is to regulate the electrical lengths of the waveguide 1 so as to correct the phase shifts introduced by its expansion.

Figure 4:
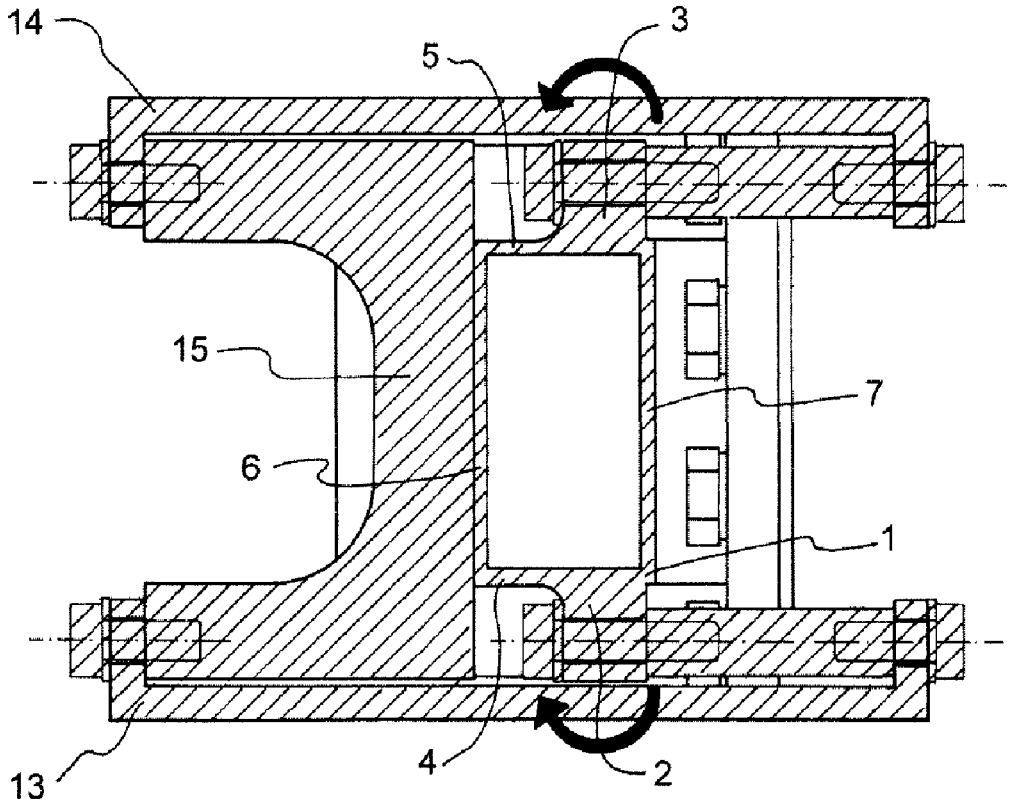
FIG. 4: a diagram showing another example of a device according to the invention.

FIG. 4 shows another exemplary embodiment according to the invention. More precisely, FIG. 4 is a diagram showing the cross section of a compensated waveguide according to the invention. The thermo-elastic differential between the prongs 13 and 14, typically made of Invar™, and the brace 15/waveguide 1 assembly, typically made of aluminium, causes the ribs 2 and 3 to rotate about themselves when there is a change in temperature. Because they have a higher coefficient of thermal expansion, the waveguide and the brace 15 would in fact contract or expand much more than the prongs 13 and 14. Tensile and compressive forces will therefore be generated and will cause the ribs 2 and 3 to rotate. Consequently, the ribs 2 and 3 will deform the short sides 4 and 5 of the waveguide 1. By correctly regulating this deformation, the device guarantees phase stability within the waveguide 1.

To summarize, the main advantage of the invention is that it ensures phase stability within the waveguide having a potentially high coefficient of thermal expansion, and subject to large temperature changes, by means of a mechanical device.

It will be readily seen by one of ordinary skill in the art that the present invention fulfils all of the objects set forth above. After reading the foregoing specification, one of ordinary skill in the art will be able to affect various changes, substitutions of equivalents and various aspects of the invention as broadly disclosed herein. It is therefore intended that the protection granted hereon be limited only by definition contained in the appended claims and equivalents thereof.

The invention claimed is:

1. Compensated waveguide device comprising:

a waveguide having a first coefficient of thermal expansion; and at least one long side and at least one short side, said short side having a median axis and said waveguide further including at least one longitudinal rib having a surface at least partly common with the short side of said waveguide over approximately one half of the width of said short side, said longitudinal rib being off-axis relative to the median axis of the short side of the waveguide and cut in the body of the waveguide, wherein said compensated waveguide device comprises, in contact with the longitudinal rib means for rotating said longitudinal rib about itself, causing a deformation of the short side of the waveguide.

2. Device according to claim 1, wherein said waveguide has a rectangular cross section and therefore comprises two short sides and two long sides.

3. Device according to claim 1, wherein said means for rotating the longitudinal rib comprise at least one element of low thermal deformability, having a second coefficient of thermal expansion smaller than said first coefficient of thermal expansion.

4. Device according to claim 3, wherein said second coefficient of thermal expansion is smaller than said first coefficient of thermal expansion by a factor of at least 5.

5. Device according to claim 3, wherein said means for rotating the longitudinal rib consist of a bimetallic strip comprising at least said element of low thermal deformability, having said second coefficient of thermal expansion, and a complementary element having a third coefficient of thermal expansion larger than said second coefficient of thermal expansion.

6. Device according to claim 5, wherein said element of low thermal deformability of the bimetallic strip is made of Invar™ and the complementary element of the bimetallic strip is made of aluminium.

7. Device according to claim 3, wherein said means for rotating the longitudinal rib comprise a first type of pair of prongs corresponding to said element of low thermal deformability, and a brace having said first coefficient of thermal expansion, fastened to the waveguide and being interposed between said prongs.

8. Device according to claim 7, wherein said prongs are made of Invar™ and said waveguide and said brace are made of aluminium.

9. Device according to claim 3, wherein said means for rotating the longitudinal rib comprise a frame having a fourth coefficient of thermal expansion larger than said second coefficient of thermal expansion and a second type of pair of prongs corresponding to said element of low thermal deformability and furthermore providing the linkage between said longitudinal rib and said frame.

10. Device according to claim 9, wherein said device comprises two opposed longitudinal ribs separated by a long side of the waveguide, and two pairs of prongs of the second type of pair of prongs connected to the ends of said longitudinal ribs.

11. Device according to claim 9, wherein said pairs of prongs are made of Invar™, said frame is made of aluminium or titanium, and said waveguide is made of aluminium or titanium.

12. Device according to claim 9, wherein said pairs of prongs are made of titanium, and said frame and said waveguide are made of aluminium.

* * * * *